US008164525B2

(12) United States Patent
Park et al.

(10) Patent No.: US 8,164,525 B2
(45) Date of Patent: Apr. 24, 2012

(54) MIMO ANTENNA AND COMMUNICATION DEVICE USING THE SAME

(75) Inventors: Se-hyun Park, Gyeonggi-do (KR); Dong-jin Kim, Gyeonggi-do (KR); Byung-tae Yoon, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 822 days.

(21) Appl. No.: 12/112,033

(22) Filed: Apr. 30, 2008

(65) Prior Publication Data

US 2009/0102742 A1 Apr. 23, 2009

(30) Foreign Application Priority Data

Oct. 17, 2007 (KR) ..... 10-2007-0104549

(51) Int. Cl.
*H01Q 1/24* (2006.01)

(52) U.S. Cl. ..... 343/702; 343/700 MS; 343/876

(58) Field of Classification Search ..... 343/702, 343/853, 876, 700 MS
See application file for complete search history.

(56) References Cited

U.S. PATENT DOCUMENTS

| | | | |
|---|---|---|---|
| 5,550,554 | A | 8/1996 | Erkocevic |
| 2002/0140612 | A1 | 10/2002 | Kadambi et al. |
| 2003/0222823 | A1 | 12/2003 | Flint et al. |
| 2004/0233111 | A1 | 11/2004 | Desclos et al. |

FOREIGN PATENT DOCUMENTS

| | | |
|---|---|---|
| EP | 1 555 715 | 7/2005 |
| FR | 2 888 675 | 1/2007 |
| JP | 09-260925 | 10/1997 |
| JP | 2005-086780 | 3/2005 |
| KR | 10-2005-0112272 | 2/2007 |
| WO | WO 02/058187 | 7/2002 |
| WO | WO 2004/084344 | 9/2004 |

OTHER PUBLICATIONS

Extended European Search Report issued on Feb. 16, 2010, in corresponding European Application No. 08160630.3 (7 pages).

*Primary Examiner* — Tho G Phan
(74) *Attorney, Agent, or Firm* — NSIP Law

(57) ABSTRACT

A multiple-input multiple-output (MIMO) antenna and an antenna system using the same are provided. The MIMO antenna includes a plurality of antenna elements in which a feeding unit is formed at one end, and another end is connected to a ground, and a connection unit which connects the antenna elements.

24 Claims, 4 Drawing Sheets

MIMO ANTENNA AND COMMUNICATION DEVICE USING THE SAME

CROSS-REFERENCE TO RELATED APPLICATIONS

This application claims the benefit under 35 U.S.C. §119 (a) of a Korean Patent Application No. 10-2007-0104549, filed on Oct. 17, 2007, in the Korean Intellectual Property Office, the disclosure of which is incorporated herein by reference in its entirety.

TECHNICAL FIELD

The following description relates to communication devices, and more particularly to, a multiple-input multiple-output (MIMO) antenna and wireless communication devices using the same.

BACKGROUND

With the demand for multimedia services of high quality in a wireless communication environment, there has been a need for a wireless transmission technique that delivers massive data at a higher rate and a lower error rate.

In order to achieve higher data transmission rates, a multi-band antenna system has been proposed. Generally, a multi-band antenna system includes a plurality of antennas, a plurality of band pass filters (BPFs), and a plurality of radio frequency (RF) circuits. Each antenna transmits and/or receives signals in different frequency bands, and each BPF and RF circuit processes signals transmitted and received through each antenna. However, use of a plurality of antennas is necessarily required which may increase the size of the antenna system.

In a multiple-input multiple-output (MIMO) antenna, an MIMO operation is carried out by arranging a plurality of antennas in a specific structure. Accordingly, it is possible to increase the data transfer rate in a specific range or expand a system range for a specific data transfer rate.

A MIMO antenna, which is believed to be the next-generation mobile communication technique applicable to mobile terminals and repeaters far and wide, is attracting attention as a new solution to overcome the limited transmission quantity of the mobile communications and wireless communication devices. It is believed that a MIMO antenna will allow for high speed broadband communication, high bandwidth, improved communication range, and high mobility. A MIMO antenna may be operated in broad or multiple frequency bands and may also improve data transmission rate between wireless communication devices.

Generally, a plurality of antennas having the same capability is embodied in a MIMO antenna. To install the MIMO antenna in a small terminal, the interval between the antennas may be narrowed. However, electromagnetic waves radiated from the antennas may interfere with each other in that situation.

The antennas may be spaced from each other at a predetermined interval, or additional devices such as a slit may be mounted to the MIMO antenna to prevent the interference between the antennas.

However, it has been difficult to reduce the interference between the antennas despite the antennas being spaced from each other at a predetermined interval.

Furthermore, the size of the MIMO antenna is increased due to the presence of the predetermined interval or the additional devices.

SUMMARY

In one general aspect, there is provided an adaptive antenna array for broad or multiple frequency bands.

In another general aspect, there is provided a multiple-input multiple-output (MIMO) antenna and a communication device using the same, in which a pair of antenna elements is directly connected without additional devices.

In still another general aspect, a multiple-input multiple-output (MIMO) antenna includes a plurality of antenna elements in which a feeding unit is formed at one end, and another end is connected to a ground, and a connection unit which connects the antenna elements.

The plurality of the antenna elements and the connection unit may be formed in a single body.

The feeding unit may be formed at one end of each of the antenna elements and another end of each of the antenna elements may be connected to the ground. The MIMO antenna may further comprise at least one switching unit provided to supply power concurrently to each of the antenna elements, or selectively to one of the antenna elements.

The connection unit may connect the antenna elements to be arranged substantially at a right angle.

The ground may be provided on a substrate, and the antenna elements may be arranged with respect to a corner of the ground or a corner of the substrate.

At least one of the antenna elements may be a strip bent in a substantially loop shape.

The MIMO antenna may further comprise a switching unit which switches the feeding unit so that power is supplied to one of the antenna elements.

The MIMO antenna may comprise a first antenna unit comprising the plurality of antenna elements in which the feeding unit is formed at the one end, and the another end is connected to the ground, and the connection unit which connects the antenna elements, and a second antenna unit comprising a plurality of antenna elements in which a feeding unit is formed at one end, and another end is connected to the ground or to another ground, and a connection unit which connects the antenna elements of the second antenna unit.

In yet another general aspect, an antenna includes an antenna element connected to a ground, and a plurality of feeding units connected to the antenna element. The antenna element may be provided to correspond to a shape of the ground or a shape of a substrate on which the ground is provided. The antenna element may be connected to the ground in at least one instance, and operable to have portions thereof with different electric fields or electric fields of different phase according to whether power is supplied concurrently to the feeding units or to one of the feeding units.

The antenna element may comprise a first antenna element arranged in a horizontal direction corresponding to the ground and a second antenna element arranged in a substantially perpendicular direction with respect to the first antenna element. The antenna element may comprise first and second antenna elements in which a substantial length of the first and/or second antenna elements face the ground. The antenna element may comprise first and second antenna elements which are operable independently to have different electric fields or electric fields of different phase. The antenna element may comprise first and second antenna elements arranged to provide corresponding radiation patterns that are substantially orthogonal in direction to each other.

The antenna may further include a connecting unit, wherein the antenna element may comprise first and second antenna elements connected by the connection unit and each of the first and second antenna elements may be connected to a corresponding one of the feeding units. The first and the second antenna elements and the connection unit may be provided as a single body. At least one of the first and second antenna elements may be provided as a folded strip. The antenna may be a multiple-input multiple-output (MIMO) antenna.

The antenna may comprise a first antenna unit comprising the antenna element connected to the ground and the plurality of feeding units connected to the antenna element, and a second antenna unit comprising an antenna element connected to the ground or to another ground, and a plurality of feeding units connected to the antenna element of the second antenna unit, wherein the first antenna unit is provided to correspond to a shape of the ground or a shape of a substrate on which the ground is provided.

In still another general aspect, an antenna system includes a first antenna unit comprising an antenna element connected to a ground in at least one instance, and a plurality of feeding units connected to the antenna element, and a second antenna unit comprising an antenna element connected to one of the ground and another ground, in at least one instance, and a plurality of feeding units connected to the antenna element of the second antenna unit.

At least one of the antenna elements of the first and second antenna units may comprise first and second antenna elements arranged substantially at a right angle.

At least one of the antenna elements of the first and second antenna units may be arranged to correspond to a shape of the ground or a shape of a substrate on which the ground is provided.

At least one of the antenna elements of the first and second antenna units may comprise first and second antenna elements which are operable independently to have different electrical fields or electric fields of different phase.

At least one of the antenna elements of the first and second antenna units may be operable to have portions thereof with different electric fields or electric fields of different phase according to whether power is supplied concurrently to the corresponding feeding units or to one of the corresponding feeding units.

At least one of the antenna elements of the first and second antenna units may comprise first and second antenna elements connected to respective ones of the corresponding feeding units. The first and second antenna elements may be connected by a connection unit, and the first and second antenna elements and the connection unit may be provided as a single body. At least one of the first and second antenna elements may be provided as a folded strip.

The antenna system may be a multiple-input multiple-output (MIMO) antenna system.

The antenna system may further comprise at least one switching unit which controls supply of power to the feeding units of the first and second antenna units. Each of the antenna elements of the first and second antenna units may comprise first and second antenna elements operable to have different electric fields or electric fields of different phase. Each of the antenna elements of the first and second antenna units may comprise first and second antenna elements, and the at least one switching unit controls supply of power to selectively operate one or more of the first and second antenna elements of the first and second antenna units.

In still another general aspect, a communication device includes any one of the antennas described herein.

Other features will become apparent to those skilled in the art from the following detailed description, which, taken in conjunction with the attached drawings, discloses exemplary embodiments of the invention.

BRIEF DESCRIPTION OF THE DRAWINGS

Throughout the drawings and the detailed description, the same drawing reference numerals will be understood to refer to the same elements, features, and structures.

DETAILED DESCRIPTION

The following detailed description is provided to assist the reader in gaining a comprehensive understanding of the methods and systems described herein. According, various changes, modifications, and equivalents of the systems and methods described herein will be suggested to those of ordinary skill in the art. Also, description of well-known functions and constructions are omitted to increase clarity and conciseness.

Figure 1:
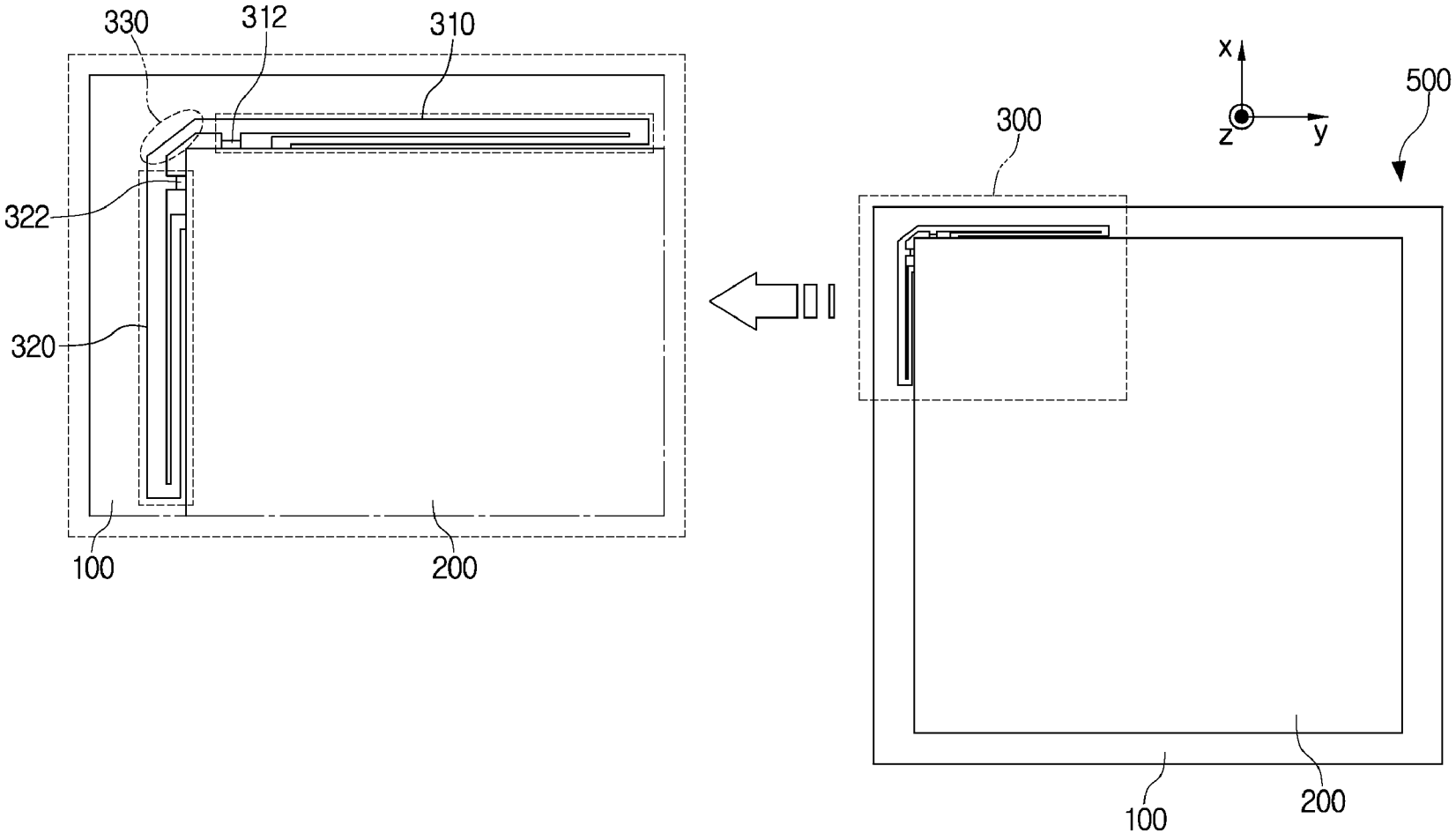
FIG. 1 is a configuration diagram illustrating an exemplary MIMO antenna.

FIG. 1 illustrates an exemplary MIMO antenna 500.

As illustrated in FIG. 1, a multiple-input multiple-output (MIMO) antenna 500 comprises a substrate 100, a ground 200, and an antenna unit 300.

The ground 200 is formed on the substrate 100. The size of the ground 200 may be smaller than that of the substrate 100. The antenna unit 300 is mounted at an outside corner of an overlapped area of the substrate 110 and the ground 200.

The antenna unit 300 may comprise antenna elements 310, 320, and a connection unit 330 which connects the antenna elements 310, 320.

It will be understood from the following description that FIG. 1 is only an exemplary embodiment and a MIMO antenna may comprise more than one antenna unit 300. Moreover, the structure of the antenna elements 310, 320 is also only an exemplary embodiment.

For ease of description, the antenna element 310 will be referred to as a first antenna element, and the antenna element 320 will be referred to as a second antenna element. The first antenna element 310 is arranged in a horizontal direction 'y', and the second antenna element 320 is arranged in a vertical direction 'x.' The first antenna element 310 and the second antenna element 320 may form an integral unit by way of the connection unit 330.

Feeding units 312, 322 are formed respectively at one end of each of the first and second antenna elements 310, 320. An other end of each of the first and second antenna elements 310, 320 is connected to the ground 200. The first and second antenna elements 310, 320 may be formed in a strip shape. Each of the first and second antenna elements 310, 320 may be bent in a substantially loop shape, and the bent strips may be parallel with each other. The first and second antenna elements 310, 320 may be formed in a "ㄷ" configuration, and connected to the ground 200 so that the first and second antenna elements 310, 320 may be formed in a folded loop configuration.

The total length of the first and second antenna elements 310, 320 may have a length of 1 wavelength. In FIG. 1, the bodies of the first and second antenna elements 310, 320 are bent, and the bent bodies are shaped in a loop configuration. Therefore, longer antenna elements may be provided in the same space.

The feeding units 312, 322 connected to one end of each of the first and second antenna elements 310, 320 may be protruded toward or extend from the ground 200, and the other end of each of the first and second antenna elements 310, 320 may be connected to the ground 200.

The connection unit 330 connects the first and second antenna elements 310, 320. Each of the feeding units 312, 322 is positioned adjacent to each other, and the first and second antenna elements 310, 320 are arranged at a predetermined angle. The connection unit 330 and the first and second antenna elements 310, 320 may be formed as a single unit or body. Therefore, the antenna elements 310, 320, connected to each other by the connection unit 330, may be operated as a single antenna element. Accordingly, an antenna unit may comprise an antenna element having a plurality of feeding units. The antenna unit may be arranged with respect to a boundary of a ground to, for example, take less space and reduce the size of a wireless communication device using the antenna unit.

The connection unit 330 may connect the first and second antenna elements 310, 320, so that the first and second antenna elements 310, 320 may be arranged at a right angle. It is understood that the angle formed by the first and second antenna elements 310, 320 may be varied. Where the antenna elements 310, 320 are connected at a predetermined angle, such as a right angle, a mutual interference between the first and second antenna elements 310, 320 may be minimized. Accordingly, the antenna elements 310, 320 may be arranged to prevent interference and/or correlation.

In FIG. 1, the first and second antenna elements 310, 320 connected by the connection unit 330 correspond to a corner of the ground 200. In this case, each of the first and second antenna elements 310, 320 are arranged substantially parallel with each of two sides extended from the corner of the ground 200. Therefore, the antenna unit 300 is provided around a corner of the ground 200.

While only one antenna unit 300 is provided in FIG. 1, the number of antenna unit is not limited thereto. For example, the antenna units 300 may be mounted with respect to four corners of a substantially rectangular ground 200. It is also understood that the ground 200 may be formed in a variety of different shapes, as may be the case in various wireless communication devices, and antenna unit 300 or an antenna unit consistent with the disclosure provided herein may be provided with respect to such a ground accordingly.

Where power is concurrently supplied to the first and second antenna elements 310, 320, one of the first and second antenna elements 310, 320 receives a maximum electric field, and the other of the first and second antenna elements 310, 320 receives a minimum electric field. Therefore, the first and second antenna elements 310, 320 operate independently, and the mutual electric interference between the first and second antenna elements 310, 320 may be suppressed.

While the antenna unit 300 is parallel with the ground 200 on the substrate 100 as illustrated in FIG. 1, it is not limited thereto. For example, the antenna unit 300 may be arranged locally at a corner of the ground 200.

The power may be concurrently supplied to the first and second antenna elements 310, 320, or selectively supplied to one of the first and second antenna elements 310, 320.

Where the power is concurrently supplied to first and second antenna elements 310, 320, at a peak of an electric field intensity of the first antenna element 310, an electric filed intensity of the second antenna element 320 may reach a minimum, or at a peak of an electric field intensity of the second antenna element 320, an electric field intensity of the first antenna element 310 may reach a minimum. Therefore, a coupling of the radiation patterns between the first and second antenna elements 310, 320 may be minimized.

While an electric field is generated around the first and second antenna elements 310, 320, an electric field is not generated around the ground 200. Therefore, the antenna characteristic may be irrespective of the size of the ground 200. As noted above, the size, location, and shape of the ground 200 may be flexibly changed according to a type of terminal applying a MIMO antenna.

Where the power is supplied to one of the first and second antenna elements 310, 320, an electric field is generated around the first and second antenna elements 310, 320 such that an electric field is generated around the antenna element 310 or 320 receiving the power, and an electric field is generated around the other antenna element 310 or 320 not receiving the power at phase difference of substantially 90 degrees. According to another aspect, where the power is concurrently supplied to the first and second antenna elements 310, 320, the first and second antenna elements 310, 320 have electric fields that are out of phase by 90 degrees.

Figure 2A:
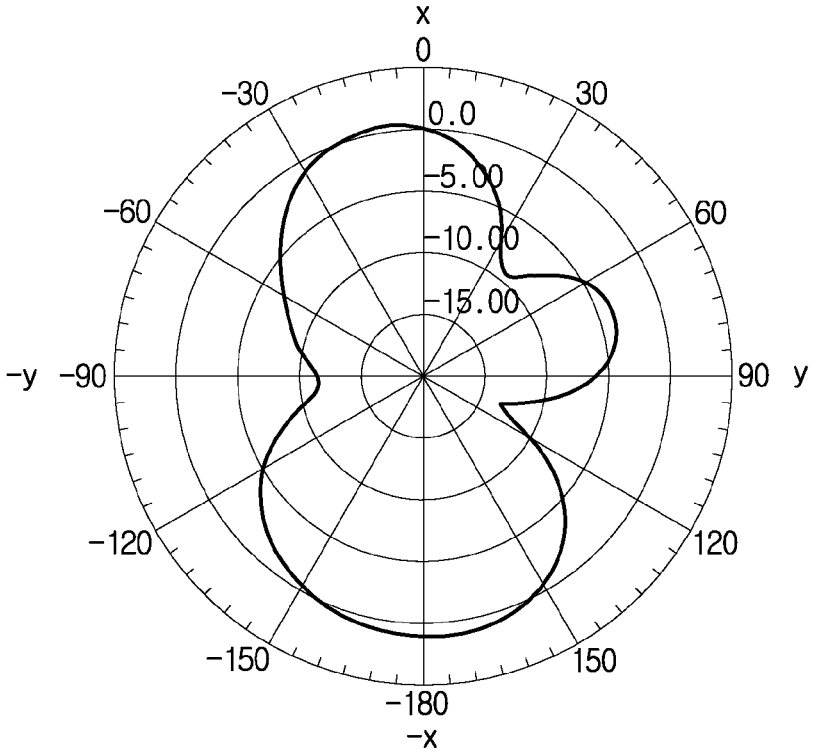
FIGS. 2A and 2B are graphs illustrating exemplary radiation patterns of a MIMO antenna.
Figure 2B:
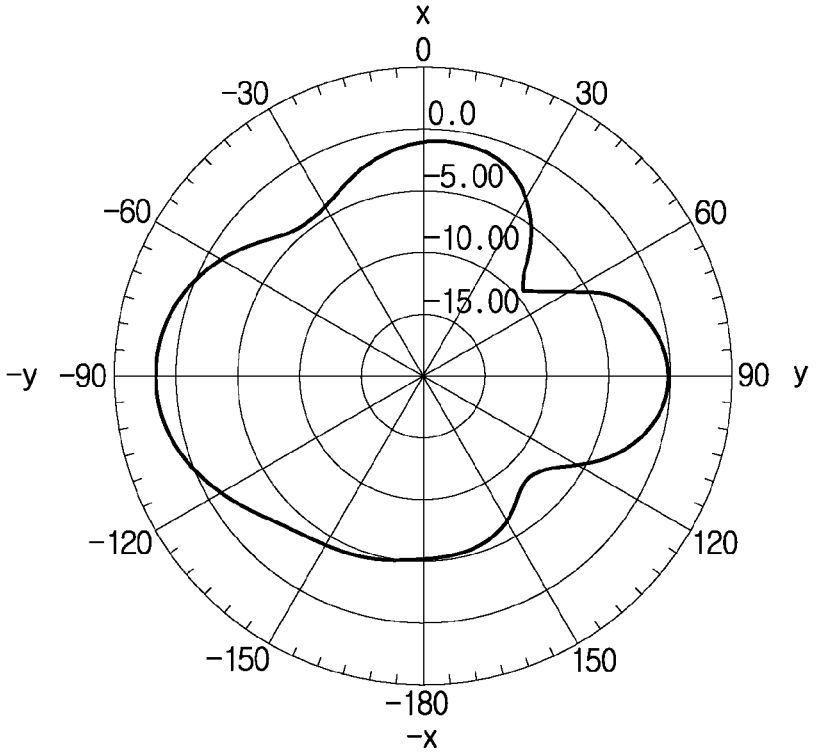

FIGS. 2A and 2B illustrate radiation patterns of a MIMO antenna according to an exemplary embodiment.

FIG. 2A illustrates a radiation pattern where power is supplied to only the feeding unit 312 of the first antenna element 310. A radiation pattern of the first antenna element 310 is formed in an X-axis direction.

FIG. 2B illustrates a radiation pattern where power is supplied to only the feeding unit 322 of the second antenna element 320. A radiation pattern of the second antenna element 320 is formed in a Y-axis direction.

Accordingly, the radiation patterns of the first and second antenna elements 310, 320 may be formed in an opposite or an orthogonal direction with respect to each other. In a general MIMO antenna, radiation patterns have been found to overlap so that a mutual interference occurs among the antennas of the general MIMO antenna. As illustrated in FIGS. 2A and 2B, the radiation patterns of the first and second antenna elements 310, 320 cross each other. Accordingly, a mutual interference caused by a radiation pattern coupling is prevented.

A scattering (S)-parameter is measured to represent frequency response characteristics of a MIMO antenna. For example, S11 represents that a signal is input and output to and from port 1. That is, a return loss of the first antenna element 310 is expressed as S11, and a return loss of the second antenna element 320 is expressed as S22. The S-parameter for a pair of ports 1, 2 is expressed as S12 or S21. Where a signal is input to port 2, and the signal is output from port 1, a return loss of the signal is expressed as S21, and a user may know the amount of the signal obtained from port 1. Where passive elements are used, S12 is equal to S21. In the case of a MIMO antenna, the lower S11, S22, S12, and S21 applicable at a resonance frequency are, the better an antenna efficiency may be.

In the MIMO antenna according to an exemplary embodiment, S21 is measured as approximately −20 dB at a center frequency band while the first and second antenna elements 310, 320 are connected. As the low parameter indicates, the MIMO antenna has a high efficiency.

To determine a mutual interference of the exemplary MIMO antenna, a correlation coefficient of the MIMO antenna is estimated using a radiation pattern and S-parameter.

It was found that the correlation coefficient estimated using the radiation pattern and S-parameter has a value 0 at the center frequency band of the MIMO antenna. That is, it was found that a mutual interference hardly occurs between the first and second antenna elements 310, 320.

Figure 3A:
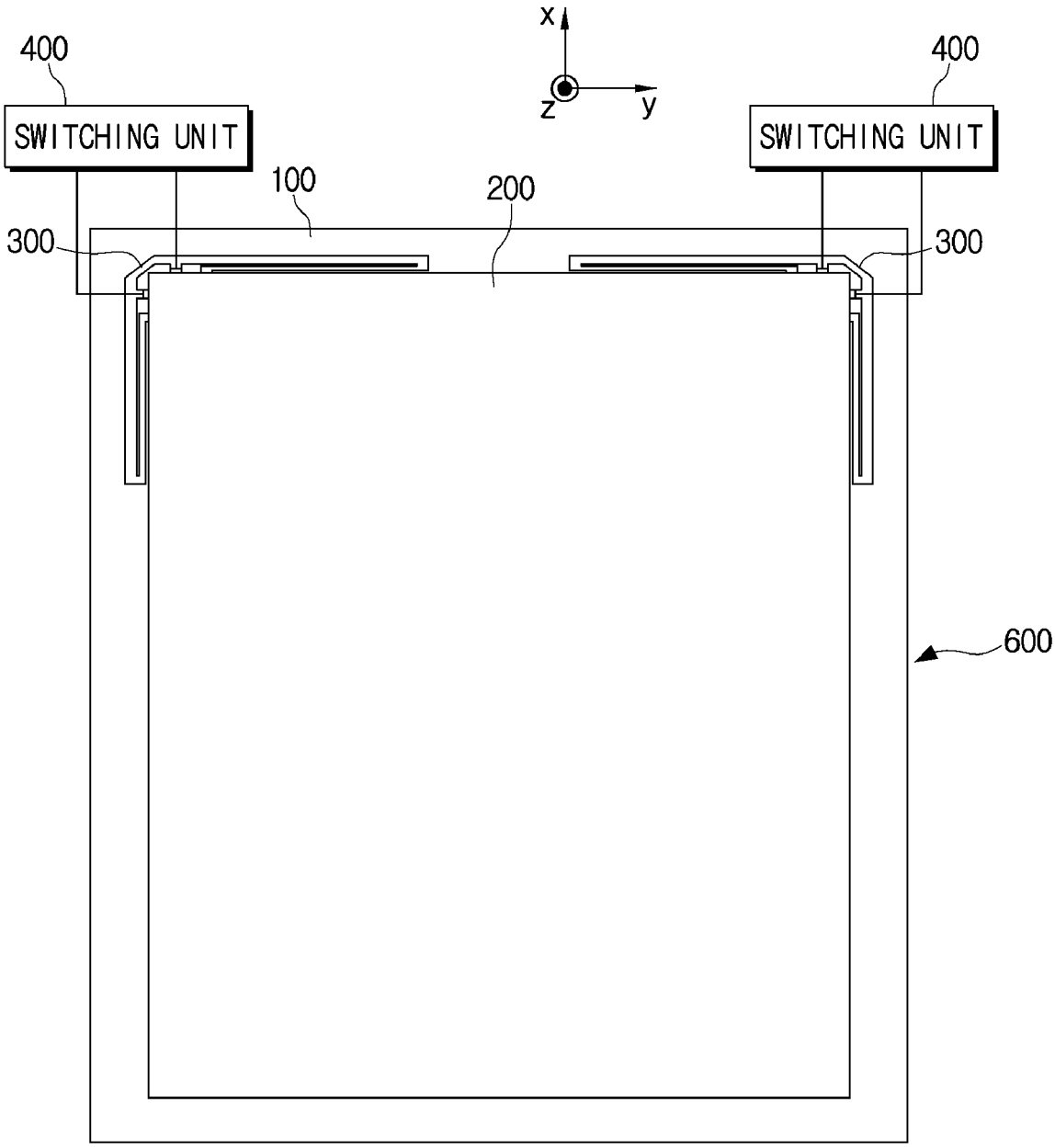
FIGS. 3A and 3B are configuration diagrams illustrating another exemplary MIMO antenna.
Figure 3B:
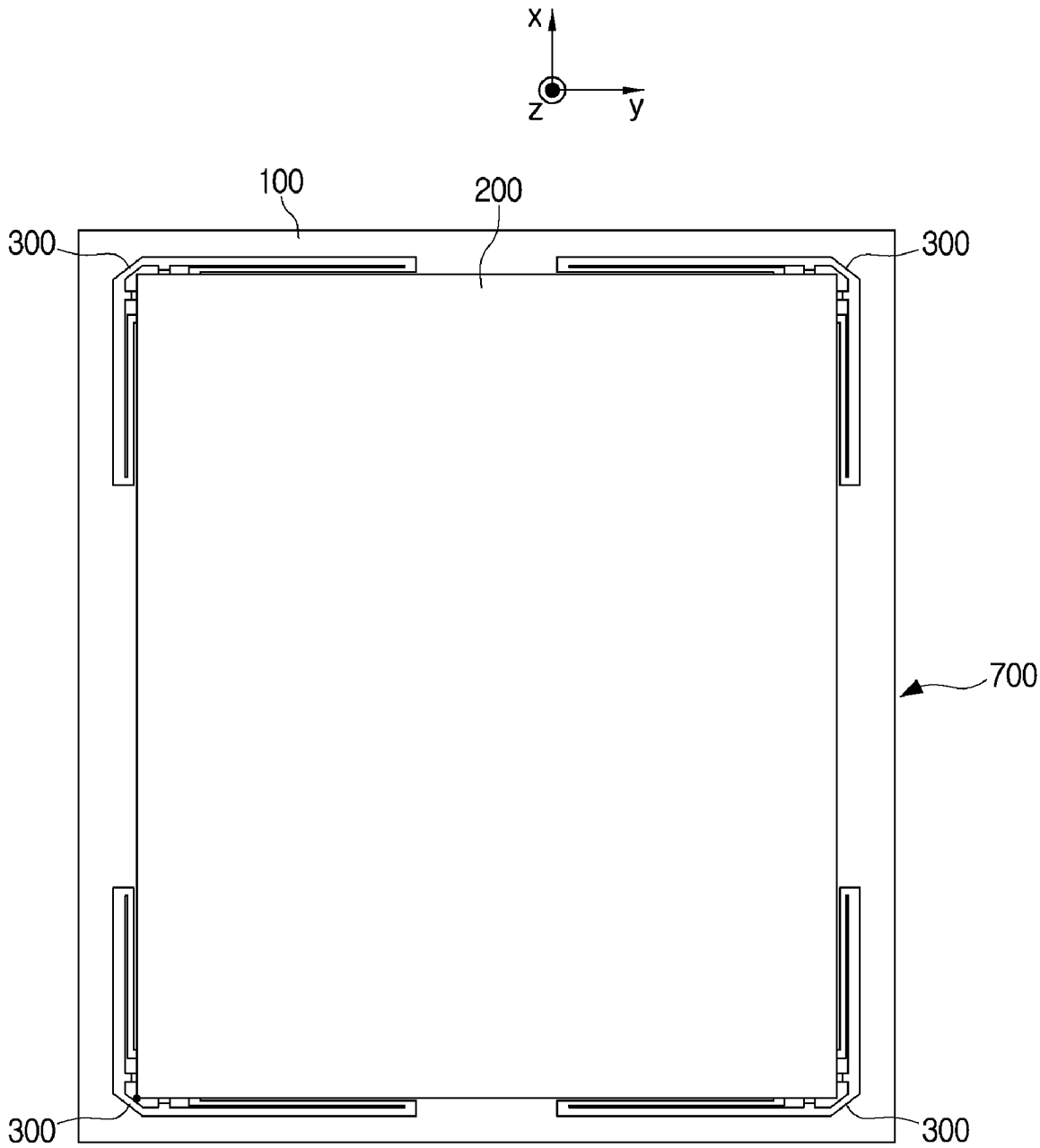

FIGS. 3A and 3B illustrate a MIMO antenna 600 and a MIMO antenna 700, respectively, according to other exemplary embodiments.

FIG. 3A illustrates a MIMO antenna 600 having two antenna units 300. The antenna units 300 are disposed at two upper corners of a ground 200 on a substrate 100. The two antenna units 300 may be symmetrically placed. For ease of description, antenna elements of the antenna units 300 are referred to as a first antenna element #1, a second antenna element #2, a third antenna element #3, and a fourth antenna element #4 from left to right of FIG. 3A.

It is understood that one or more of the four antenna elements #1, #2, #3, #4 may operate. For example, each of the antenna units 300 may have a switching unit 400 to control the corresponding feeding units 312, 322, and power may be supplied to one of the antenna elements 310, 320 (see FIG. 1). That is, the antenna elements #1, #2, #3, #4 of the MIMO antenna 600 may be selectively operated such that, for example, two out of four antenna elements #1, #2, #3, and #4 may operate. As a further example, the MIMO antenna 600 may be operated such that the antenna elements #1 or #2, and #3 or #4 have a higher electric field.

The power may be supplied to one or more of the antenna elements #1, #2, #3, #4 by way of the one or more switching units 400, or by other methods and/or apparatuses known or to be known to one skilled in the art.

FIG. 3B illustrates an exemplary MIMO antenna 700 having four antenna units 300. In this embodiment, a substrate 100 and a ground 200 of substantially rectangular configuration have four corners, respectively, and the four antenna units 300 are provided with respect to the corners of the ground 200 on the substrate 100.

As described above with respect to FIG. 3A, all the antenna elements of the MIMO antenna 700 may operate, or the antenna elements may be selectively operated.

A switching unit is not illustrated in FIG. 3B, but may be provided as illustrated in FIG. 3A.

The two antenna units 300 of FIG. 3A may operate as two-MIMO antennas, in which the antenna elements #1, #2, #3, and #4 may be associated into, for example, the first and third antenna elements #1, #3, the first and fourth elements #1, #4, the second and third antenna elements #2, #3, and the second and fourth antenna elements #2, #4. The four antenna units 400 of FIG. 3B may operate as four-MIMO antennas. Each antenna unit 300 may be used as MIMO diversity antennas.

In is understood that exemplary MIMO antennas may be used in a variety of known and to be known communication devices including wireless communication devices and portable or mobile communication devices. As an illustration, such devices include cellular phones, notebook computers, portable media players (PMPs), personal digital assistants (PDAs), and the like.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An antenna to communicate a wireless communication signal, comprising:

an antenna element connected to a ground, the antenna element being formed adjacent and substantially coplanar to the ground, the antenna element comprising first and second antenna elements;

a plurality of feeding units connected to the antenna element, each of the first and second antenna elements being connected to a corresponding one of the feeding units; and a connecting unit that connects the first and second antenna elements.

2. The antenna of claim 1, wherein the antenna element corresponds to a shape of the ground or a shape of a substrate on which the ground is provided.

3. The antenna of claim 2, wherein:

the first antenna element is arranged in a horizontal direction corresponding to the ground; and the second antenna element is arranged in a substantially perpendicular direction with respect to the first antenna element.

4. The antenna of claim 1, wherein a substantial length of the first antenna element, a substantial length of the second antenna element, or any combination thereof faces the ground.

5. The antenna of claim 1, wherein the first and second antenna elements are operable independently to have different electric fields or electric fields of different phase.

6. The antenna of claim 1, wherein the first and the second antenna elements and the connection unit are provided as a single body.

7. The antenna of claim 1, wherein the first antenna element, the second antennas element, or any combination thereof is provided as a folded strip.

8. The antenna of claim 1, wherein the antenna element is connected to the ground in at least one instance, and is operable to have portions thereof with different electric fields or electric fields of different phase according to whether power is supplied concurrently to the feeding units or to whether power is supplied to one of the feeding units.

9. The antenna of claim 1, wherein the first and second antenna elements are arranged to provide corresponding radiation patterns that are substantially orthogonal in direction to each other.

10. The antenna of claim 1, wherein the antenna is a multiple-input multiple-output (MIMO) antenna.

11. The antenna of claim 1, further comprising:

a first antenna unit, comprising:

the antenna element;

the plurality of feeding units; and the connecting unit; and a second antenna unit comprising:

an other antenna element connected to the ground or to an other ground, the other antenna element being formed adjacent to the ground or to the other ground and comprising third and fourth antenna elements; and a plurality of second feeding units connected to the other antenna element, each of the third and fourth antenna element being connected to a corresponding one of the second feeding units; and a second connecting unit that connected the third and fourth antenna elements, wherein the first antenna unit corresponds to a shape of the ground or a shape of a substrate on which the ground is provided.

12. A communication device comprising the antenna as claimed in claim 1.

13. The antenna of claim 1, further comprising:

a substrate on which the ground is formed, a size of the substrate being greater than a size of the ground, wherein the antenna element is formed at an outside corner of an overlapped area of the substrate and the ground.

14. An antenna system, comprising:

a first antenna unit, comprising:

a first antenna element connected to a ground in at least one instance, the first antenna element being formed adjacent to the ground and comprising second and third antenna elements;

a plurality of first feeding units connected to the first antenna element, each of the second and third antenna elements being connected to a corresponding one of the first feeding units; and a first connecting unit that connects the second and third antenna elements; and a second antenna unit, comprising:

a fourth antenna element connected to the ground or an other ground in at least one instance, the second antenna element being formed adjacent to the ground or the other ground and comprising fifth and sixth antenna elements; and a plurality of second feeding units connected to the second antenna element, each of the fifth and sixth antenna element being connected to a corresponding one of the second feeding units; and a second connecting unit that connects the fifth and sixth antenna elements.

15. The antenna system of claim 14, wherein the second and third antenna elements, the fifth and sixth antenna elements, or any combination thereof are arranged substantially at a right angle.

16. The antenna system of claim 14, wherein the first antenna element, the fourth antenna element, or any combination thereof corresponds to a shape of the ground or the other ground or a shape of a substrate on which the ground or the other ground is provided.

17. The antenna system of claim 14, wherein the second and third antenna elements, the fifth and sixth antenna elements, or any combination thereof are operable independently to have different electrical fields or electric fields of different phase.

18. The antenna system of claim 14, wherein the first antenna element, the fourth antenna element, or any combination thereof is operable to have portions thereof with different electric fields or electric fields of different phase according to whether power is supplied concurrently to corresponding ones of the first or second feeding units or whether power is supplied to one of the corresponding ones of the first or second feeding units.

19. The antenna system of claim 14, wherein the first antenna element, the fourth antenna element, or any combination thereof is provided as a folded strip.

20. The antenna system of claim 14, wherein the antenna system is a multiple-input multiple-output (MIMO) antenna system.

21. The antenna system of claim 14, further comprising:

at least one switching unit which controls a supply of power to the feeding units of the first and second antenna units.

22. The antenna system of claim 21, wherein second and third antenna elements and the fifth and sixth antenna elements are operable to have different electric fields or electric fields of different phase.

23. The antenna system of claim 21, wherein the at least one switching unit controls a supply of power to selectively operate one or more of the second and third antenna elements and one or more of the fifth and sixth antenna elements.

24. A communication device comprising the antenna as claimed in claim 14.

* * * * *